US005742920A

United States Patent [19]

Cannuscio et al.

[11] Patent Number: 5,742,920

[45] Date of Patent: *Apr. 21, 1998

[54] DISPLAY FOR A TEMPERATURE CONTROL SYSTEM

[75] Inventors: Robert E. Cannuscio, North Wales, Pa.; Thomas J. Hollis, 5 Roxbury Dr., Medford, N.J. 08055

[73] Assignee: Thomas J. Hollis, Medford, N.J.

[ * ] Notice: The term of this patent shall not extend beyond the expiration date of Pat. No. 5,507,251.

[21] Appl. No.: 507,100

[22] Filed: Jul. 26, 1995

[51] Int. Cl.[6] ..... G06F 7/70

[52] U.S. Cl. ..... 701/102; 701/101; 701/1; 701/29; 340/449; 340/870.11; 123/41.1; 123/142.5 R; 123/41.33; 364/557

[58] Field of Search ..... 364/431.04, 431.03, 364/424.058, 550, 494, 424.035, 423.098, 557, 556, 424.034, 431.09, 442; 123/142.5 R, 196 AB, 41.1, 41.33, 41.44, 41.08, 421, 556, 568; 340/620, 626, 635, 670, 449, 457.4, 459, 451, 462, 870.11, 870.21, 870.38; 73/304 R, 304 C, 53.05, 117.3; 374/145

[56] References Cited

U.S. PATENT DOCUMENTS

| | | | |
|---|---|---|---|
| 2,134,778 | 1/1938 | Clarke . | |
| 3,723,964 | 3/1973 | Lace | 340/459 |
| 3,866,166 | 2/1975 | Kerscher, III et al. | 364/424.034 |
| 3,906,437 | 9/1975 | Branwein et al. | 364/424.034 |
| 4,399,774 | 8/1983 | Tsutsumi | 123/41.1 |
| 4,629,334 | 12/1986 | Hochstein | 374/103 |
| 4,926,331 | 5/1990 | Windle et al. | 364/424.038 |
| 4,989,150 | 1/1991 | Tarzawa | 364/431.03 |
| 5,056,026 | 10/1991 | Mitchell et al. | 364/431.03 |
| 5,170,755 | 12/1992 | Kano et al. | 123/90.17 |
| 5,174,254 | 12/1992 | Humburg | 123/142.5 R |
| 5,339,244 | 8/1994 | Stiles, Jr. et al. | 364/424.06 |
| 5,415,147 | 5/1995 | Nagle et al. | 123/563 |
| 5,416,728 | 5/1995 | Rudzewicz et al. | 364/423.098 |
| 5,422,824 | 6/1995 | Biehler | 364/494 |
| 5,458,096 | 10/1995 | Hollis | 123/41.1 |
| 5,467,745 | 11/1995 | Hollis | 123/41.1 |
| 5,483,927 | 1/1996 | Letang et al. | 123/41.12 |
| 5,503,118 | 4/1996 | Hollis | 123/41.44 |
| 5,505,164 | 4/1996 | Hollis | 123/41.1 |
| 5,507,251 | 4/1996 | Hollis | 123/41.1 |
| 5,551,384 | 9/1996 | Hollis | 123/142.5 R |

FOREIGN PATENT DOCUMENTS

| | | |
|---|---|---|
| 34 35 833 | 4/1986 | Germany . |
| 35 16 502 | 11/1986 | Germany . |
| 40 33 261 | 4/1992 | Germany . |

*Primary Examiner*—Jacques Louis-Jacques
*Attorney, Agent, or Firm*—Seidel, Gonda, Lavorgna & Monaco

[57] ABSTRACT

A system for displaying engine temperature information for a temperature control system in an internal combustion engine. A first temperature sensor senses the temperature of ambient air. A second temperature sensor senses the temperature of an engine oil. A third temperature sensor senses the temperature of a temperature control fluid. The sensors provide signals indicative of the sensed temperatures to an engine computer. The engine computer compares the sensed ambient air temperature to a first set of predetermined values to determine a desired engine oil temperature. The engine computer also compares the sensed ambient air temperature to a second set of predetermined values to determine a desired temperature control fluid temperature. A signal indicative of the desired engine oil temperature and/or the desired temperature control fluid temperature is output from the engine computer to a display system. The display system displays the desired and the sensed temperature signals. The display system may be incorporated into the instrument panel of a vehicle. Alternately the display system may be part of a testing apparatus for testing the operational state of the temperature control system. One or more gauges may be incorporated into the display for accurately displaying the desired and sensed temperatures.

35 Claims, 9 Drawing Sheets

AT AMBIENT AIR TEMPERTURE = 80°

AT AMBIENT AIR TEMPERATURE = 0°F

DISPLAY FOR A TEMPERATURE CONTROL SYSTEM

CROSS-REFERENCE TO RELATED APPLICATIONS

This application is related to U.S. application Ser. No. 08/390,711, filed Feb. 17, 1995, now abandoned and entitled "SYSTEM FOR MAINTAINING ENGINE OIL AT AN OPTIMUM TEMPERATURE," which is a continuation-in-part of U.S. application Ser. No. 08/306,272, filed Sept. 14, 1994, now U.S. Pat. No. 5,467,745 and entitled "SYSTEM FOR DETERMINING THE APPROPRIATE STATE OF A FLOW CONTROL VALVE AND CONTROLLING ITS STATE." The entire disclosures of both of these applications are incorporated herein by reference. This application is also related to co-pending U.S. application Ser. No. 08/306,240, filed Sept. 14, 1994, now U.S. Pat. No. 5,458,096 and entitled "HYDRAULICALLY OPERATED ELECTRONIC ENGINE TEMPERATURE CONTROL VALVE," and to U.S. application Ser. No. 08/306,281, filed Sept. 14, 1994, now U.S. Pat. No. 5,463,986 and entitled "HYDRAULICALLY OPERATED RESTRICTOR/SHUTOFF FLOW CONTROL VALVE." The entire disclosures of both of these applications are also incorporated herein by reference. This application is also related to U.S. application Ser. No. 08/469,957, filed Jun. 6, 1995, now U.S. Pat. No. 5,507,251 entitled "SYSTEM FOR DETERMINING THE LOAD CONDITION OF AN ENGINE FOR MAINTAINING ENGINE OIL AT AN OPTIMUM TEMPERATURE," which is incorporated herein by reference.

FIELD OF THE INVENTION

This invention relates to a system for displaying the actual and optimum engine oil temperature in an internal combustion gasoline or diesel engine.

BACKGROUND OF THE INVENTION

Page 169 of the *Goodheart-Willcox automotive encyclopedia*, The Goodheart-Willcox Company, Inc., South Holland, Ill., 1995 describes that as fuel is burned in an internal combustion engine, about one-third of the heat energy in the fuel is converted to power. Another third goes out the exhaust pipe unused, and the remaining third must be handled by a cooling system. This third is often underestimated and even less understood.

Most internal combustion engines employ a pressurized cooling system to dissipate the heat energy generated by the combustion process. The cooling system circulates water or liquid coolant through a water jacket which surrounds certain parts of the engine (e.g., block, cylinder, cylinder head, pistons). The heat energy is transferred from the engine parts to the coolant in the water jacket. In hot ambient air temperature environments, or when the engine is working hard, the transferred heat energy will be so great that it will cause the liquid coolant to boil (i.e., vaporize) and destroy the cooling system. To prevent this from happening, the hot coolant is circulated through a radiator well before it reaches its boiling point. The radiator dissipates enough of the heat energy to the surrounding air to maintain the coolant in the liquid state.

In cold ambient air temperature environments, especially below zero degrees Fahrenheit, or when a cold engine is stared, the coolant rarely becomes hot enough to boil. Thus, the coolant does not need to flow through the radiator. Nor is it desirable to dissipate the heat energy in the coolant in such environments since internal combustion engines operate most efficiently and pollute the least when they are running relatively hot. A cold running engine will have significantly greater sliding friction between the pistons and respective cylinder walls than a hot running engine because oil viscosity decreases with temperature. A cold running engine will also have less complete combustion in the engine combustion chamber and will build up sludge more rapidly than a hot running engine. In an attempt to increase the combustion when the engine is cold, a richer fuel is provided. All of these factors lower fuel economy and increase levels of hydrocarbon exhaust emissions.

To avoid running the coolant through the radiator, coolant systems employ a thermostat. The thermostat operates as a one-way valve, blocking or allowing flow to the radiator. FIG. 2 of U.S. Pat. No. 4,545,333 shows a typical prior art thermostat controlled coolant systems. Most prior art coolant systems employ wax pellet type or bimetallic coil type thermostats. These thermostats are self-contained devices which open and close according to precalibrated temperature values.

Coolant systems must perform a plurality of functions, in addition to cooling the engine parts. In cold weather, the cooling system must deliver hot coolant to heat exchangers associated with the heating and defrosting system so that the heater and defroster can deliver warm air to the passenger compartment and windows. The coolant system must also deliver hot coolant to the intake manifold to heat incoming air destined for combustion, especially in cold ambient air temperature environments, or when a cold engine is started. Ideally, the coolant system should also reduce its volume and speed of flow when the engine parts are cold so as to allow the engine to reach an optimum hot operating temperature. Since one or both of the intake manifold and heater need hot coolant in cold ambient air temperatures and/or during engine start-up, it is not practical to completely shut off the coolant flow through the engine block.

Practical design constraints limit the ability of the coolant system to adapt to a wide range of operating environments. For example, the heat removing capacity is limited by the size of the radiator and the volume and speed of coolant flow. The state of the self-contained prior art wax pellet type or bimetallic coil type thermostats is controlled solely by coolant temperature. Thus, other factors such as ambient air temperature cannot be taken into account when setting the state of such thermostats.

Numerous proposals have been set forth in the prior art to more carefully tailor the coolant system to the needs of the vehicle and to improve upon the relatively inflexible prior art thermostats. Several of these prior art systems are described in co-pending U.S. application Ser. No. 08/390,711 which is identified above and incorporated herein by reference.

The above referenced co-pending related applications disclose a unique temperature control system for controlling the flow of temperature control fluid in an internal combustion engine. These co-pending applications also discuss in detail the effect that cold temperatures have on the oil in an engine. Specifically, when the temperature of the oil in an engine falls below approximately 190 degrees Fahrenheit, sludge begins to develop which contaminates the oil. This typically occurs in prior art thermostatic engines during start-up and warm-up. During these periods of operation, the coolant temperature rises more rapidly than the internal engine temperature. Since the thermostat is actuated by coolant temperature, it often opens before the internal engine temperature has reached its optimum value, thereby causing coolant in the water jacket to prematurely cool the engine. As a result, a cold running engine will have less complete combustion in the engine combustion chamber and will build up sludge more rapidly than a hot running engine.

In co-pending U.S. application Ser. No. No. 08/390,711, a novel system for controlling the temperature of temperature control fluid is disclosed. The novel system utilizes one or more temperature control curves for actuating flow control valves in the system. The temperature control valves and system configuration are designed to maintain the engine lubricating oil at or near its optimum operating temperature.

The novel temperature control system disclosed in the above-referenced related applications does not necessarily cooperate with existing display systems. Standard automotive instrument and test panels display the actual engine oil operating temperature as compared to a static range of acceptable operating temperatures. These prior art methods for displaying engine oil data do not readily account for the variability of the optimum engine oil temperature as a function of the ambient air temperature. Similarly, standard displays compare actual coolant temperature to a preset range of acceptable coolant temperatures that also do not vary with ambient temperature.

A need therefore exists for providing a system for displaying actual and optimum engine oil operating temperatures which is useful and informative to the user.

SUMMARY OF THE INVENTION

The present invention provides a system for displaying engine temperature information for a temperature control system in an internal combustion engine. The system includes a first temperature sensor which senses the temperature of ambient air. A second temperature sensor senses the temperature of an engine oil. A third temperature sensor senses the temperature of a temperature control fluid. The sensors provide signals indicative of the sensed temperatures to an engine computer. The engine computer compares the sensed ambient air temperature to a first set of predetermined values having an ambient air temperature component and an engine oil temperature component. From this comparison the engine computer determines a desired engine oil temperature. A signal indicative of the desired engine oil temperature and/or the desired temperature control fluid temperature is output from the engine computer to a display system. The display system displays the desired engine oil temperature signal and the sensed engine oil temperature signal. Alternately the display system displays the sensed temperature control fluid temperature and the desired temperature control fluid temperature.

In one embodiment of the invention the display is an analog display. The indicator needle displays the sensed engine oil temperature as received by the engine control unit or from the engine oil sensor. The analog display includes a series of temperature zones. Each zone represents a range of engine oil temperature values. The zones may be color coded and/or shaded to provide the user with relevant information regarding the temperature state of the vehicle.

In a second analog gauge embodiment, the gauge includes one or more temperature marks which represent temperature values. Preferably one temperature mark represents the desired engine oil temperature as determined by the engine computer and is located at a preferred location. The desired engine oil temperature is always located approximately in the same location on the gauge regardless of its temperature value. The indicator needle is controlled so as to be a functional representation of the sensed engine oil temperature.

A digital display embodiment is disclosed which displays the desired engine oil temperature on the instrument panel. The sensed temperature state of the vehicle may be displayed as a series of indicator lights representing various temperature ranges. Alternately, the sensed engine oil temperature may be displayed as a digitally generated numeric value located adjacent to the desired engine oil temperature.

In an alternate embodiment, a tape gauge is utilized to indicate the various temperature values. The sensed and desired engine oil temperatures are displayed as indicators. In yet another embodiment, a bar graph is used to illustrate the sensed and the desired engine oil temperatures.

It is also contemplated that the temperature of the temperature control fluid may be displayed on the instrument panel. A light indicator is incorporated in one embodiment to indicate to the operator when the engine oil temperature and/or temperature control fluid temperature has exceeded a temperature value so as to permit the vehicle to be safely operated.

The display system according to the present invention may also be incorporated into a testing apparatus. The testing apparatus allows a maintenance person to send one or more signals to the engine control unit for determining the operational state of the temperature control system. Any of the disclosed gauges may be used by the maintenance person to monitor the engine oil temperature and/or the temperature control fluid temperature.

The foregoing and other objects features and advantages of the present invention will become more apparent in light of the following detailed description of the preferred embodiments thereof, as illustrated in the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
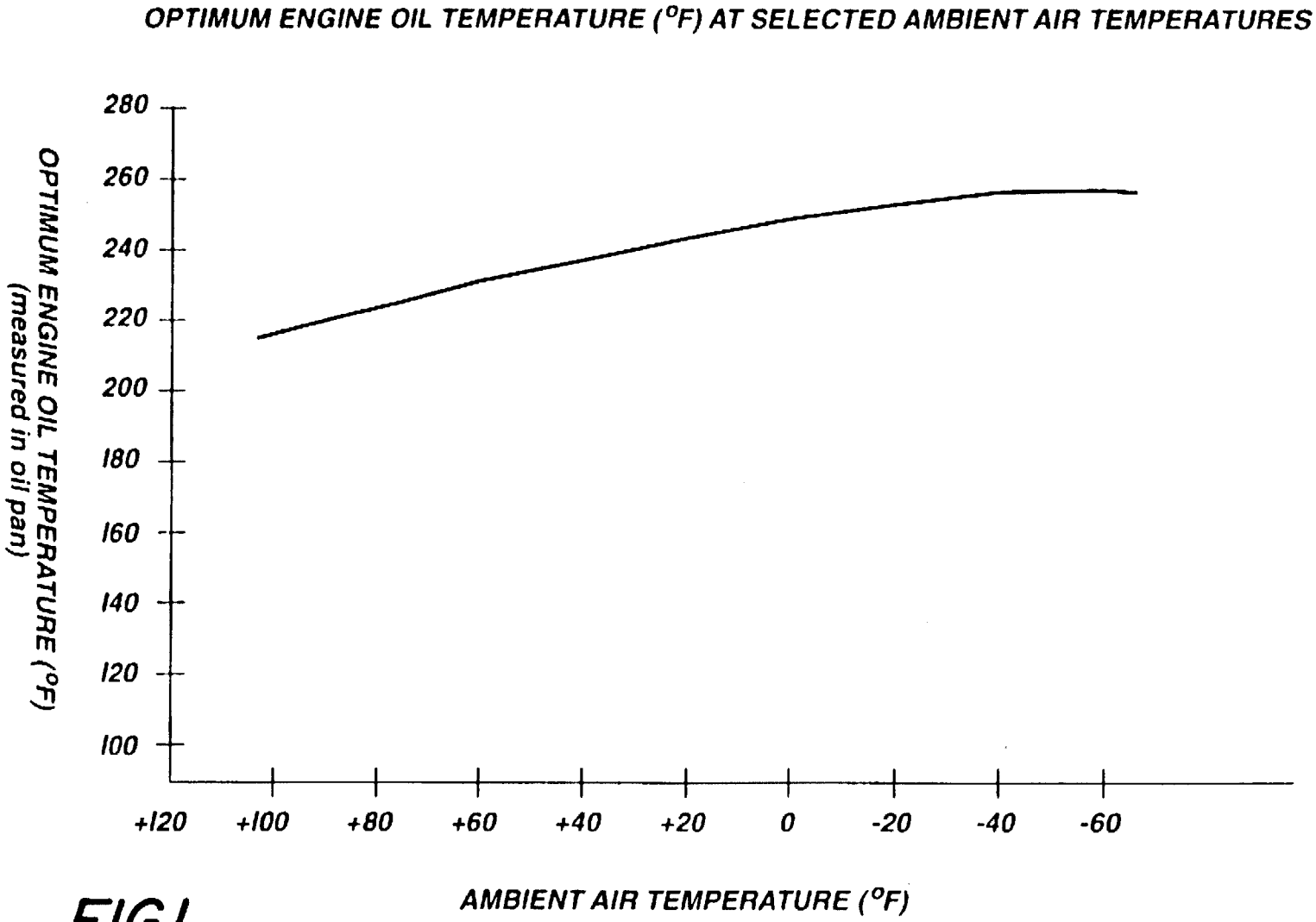
FIG. 1 is an illustration of an optimum engine oil temperature curve for an internal combustion engine.

FIG. 1 is a graphical illustration of an optimum temperature curve for engine lubricating oil in an internal combustion engine. In the embodiment illustrated, the optimum engine oil temperature varies with ambient air temperature. The illustrated curve has been empirically determined for a GM 3800 V6 transverse engine. The optimum engine oil temperature curve is utilized in conjunction with a temperature control system for maintaining the engine oil at or near its optimum temperature value. The temperature control system determines a desired engine oil temperature based on ambient air temperature. The temperature control system then monitors the actual temperature of the engine oil and controls the flow of temperature control fluid through the engine so as to drive the actual engine oil towards the desired engine oil temperature. The preferred temperature control system controls the flow of temperature control fluid by actuating one or more flow control valves in accordance with a temperature control curve.

Figure 2:
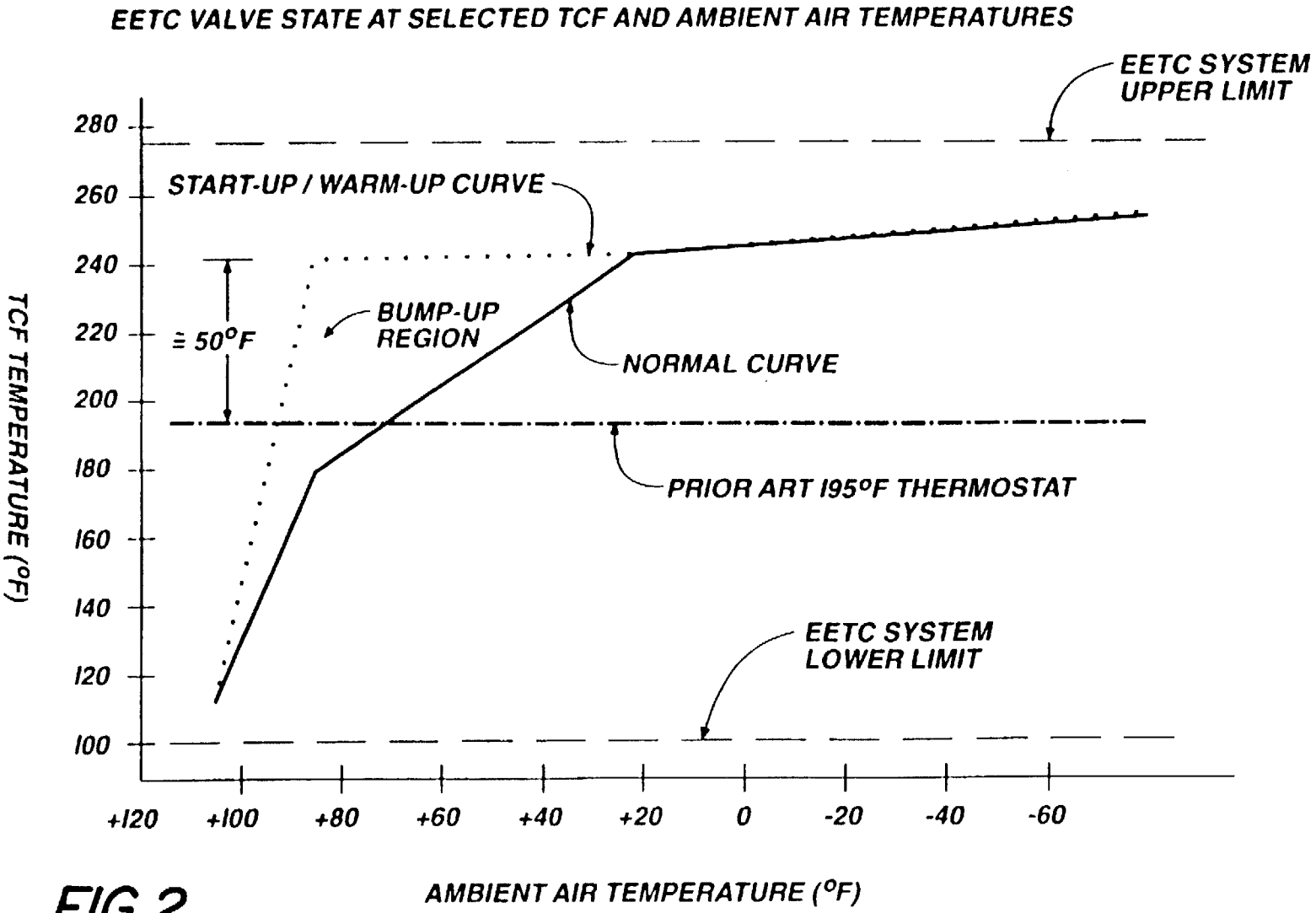
FIG. 2 is a exemplary embodiment of a temperature control curve for determining the position or state of a flow control valve.

FIG. 2 illustrates one exemplary temperature control curve for controlling the valves. The temperature control curve is defined by a set of predetermined values having a temperature control fluid temperature component and an ambient air temperature component. The solid line in FIG. 2 represents a normal temperature control curve which is utilized by the system during normal operation of the engine when it is fully warmed. When the engine is initially started, a "bump-up" version of the curve is utilized (represented by the dotted line in FIG. 2). Some preferred temperature control systems are disclosed in related U.S. application Ser. No. 08/390,711 entitled "SYSTEM FOR MAINTAINING ENGINE OIL AT AN OPTIMUM TEMPERATURE," and U.S. application Ser. No. 08/469,957, filed Jun. 6, 1995, now U.S. Pat. No. 5,507,251 entitled "SYSTEM FOR DETERMINING THE LOAD CONDITION OF AN ENGINE FOR MAINTAINING ENGINE OIL AT AN OPTIMUM TEMPERATURE."

An engine computer or engine control unit (ECU) receives sensed signals indicative of actual or sensed ambient air temperature and actual or sensed temperature control fluid temperature. The ECU compares these sensed temperatures to the temperature control curve to determine the desired position of the valve. The computer then sends signals for actuating the valve into the desired position.

Figure 3:
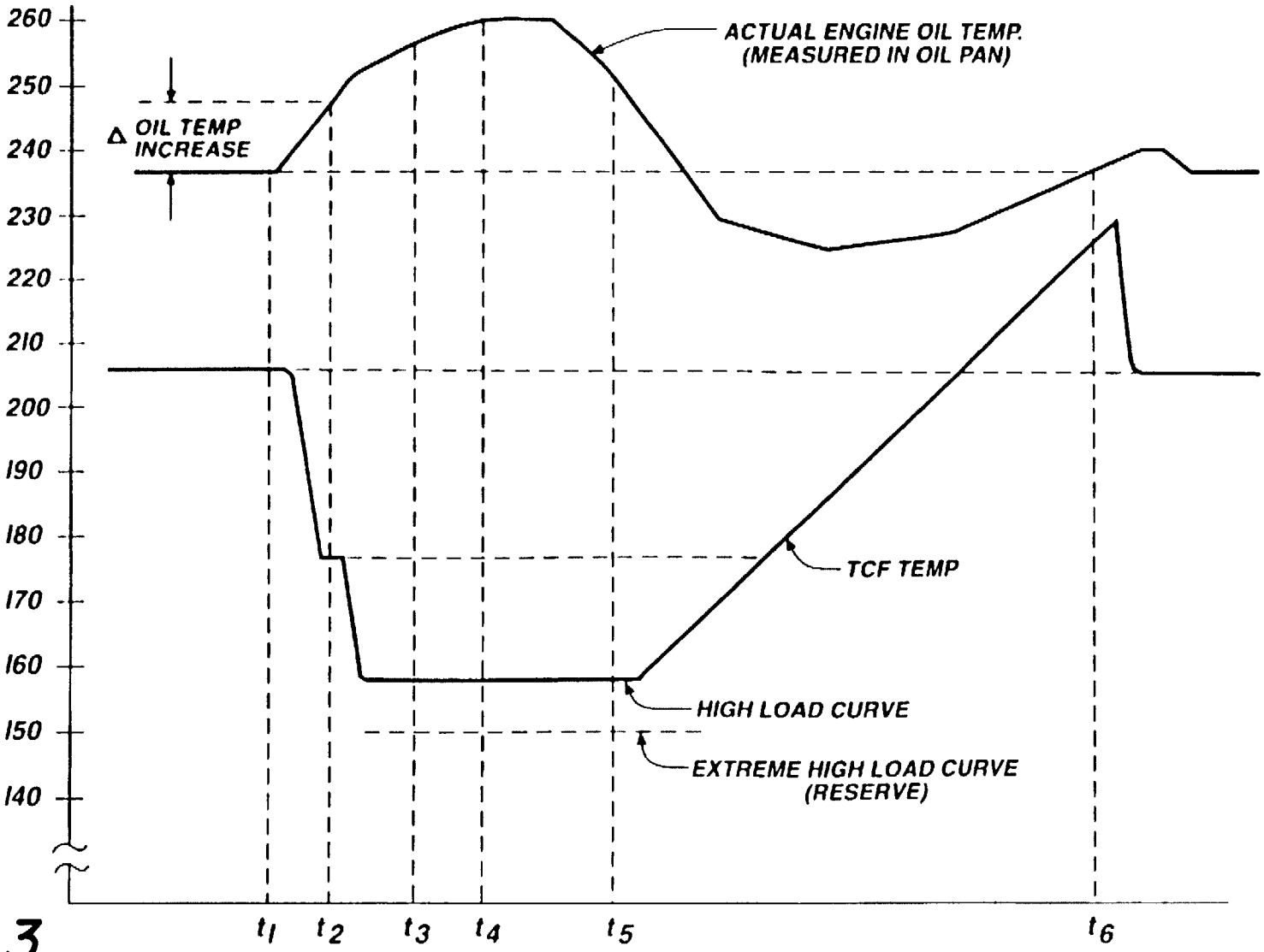
FIG. 3 is a plotted curve showing actual engine oil temperature and the temperature control fluid temperature over a time period during which the engine was subjected to varying load conditions.

The engine load condition is also preferably monitored by the ECU. Determining the engine load condition assists the ECU in anticipating engine oil temperature changes. For example, FIG. 3 graphically illustrates the effect that a change in load condition has on engine oil. At time $t_1$, the engine oil begins to rise in temperature. This generally is a sign that the engine is experiencing an increase in load. If left uncontrolled, the temperature will keep rising to an equilibrium point at a higher temperature state. However, this higher temperature state may not be desirable. In order to reduce the engine oil temperature, the temperature control system decreases the temperature of the temperature control fluid by opening one or more flow control valves in accordance with a normal temperature control curve similar to one shown in FIG. 2.

At time $t_2$, the ECU continues to detect an increase in the engine oil temperature. The ECU determines that the engine is experiencing a high load condition and modifies or adjusts the temperature control curve so as to further cool the engine oil. U.S. application Ser. No. 08/469,957, filed Jun. 6, 1995, now U.S. Pat. No. 5,507,251 and entitled "SYSTEM FOR DETERMINING THE LOAD CONDITION OF AN ENGINE FOR MAINTAINING ENGINE OIL AT AN OPTIMUM TEMPERATURE" discloses several methods for adjusting the temperature control curve as a function of the engine load condition.

In many instances it is important that the actual and desired engine oil temperatures and/or temperature control fluid temperatures be displayed to the user. For instance, after initial engine ignition, the operator of a vehicle may desire to know when the engine oil has reached its minimal operating temperature (i.e., sufficiently warmed to prevent or minimize engine damage) before engaging the transmission. The instrument panels in many of today's vehicles include one or more temperature gauges. These gauges provide the operator with information about the temperature of the engine oil and/or the temperature of the coolant. In these gauges the actual temperature is compared against a fixed predetermined range of acceptable values. As stated above, the prior art gauges do not provide the operator with an indication of a desired engine oil temperature and/or temperature control fluid temperature for the current operational state of the vehicle.

Figure 4:
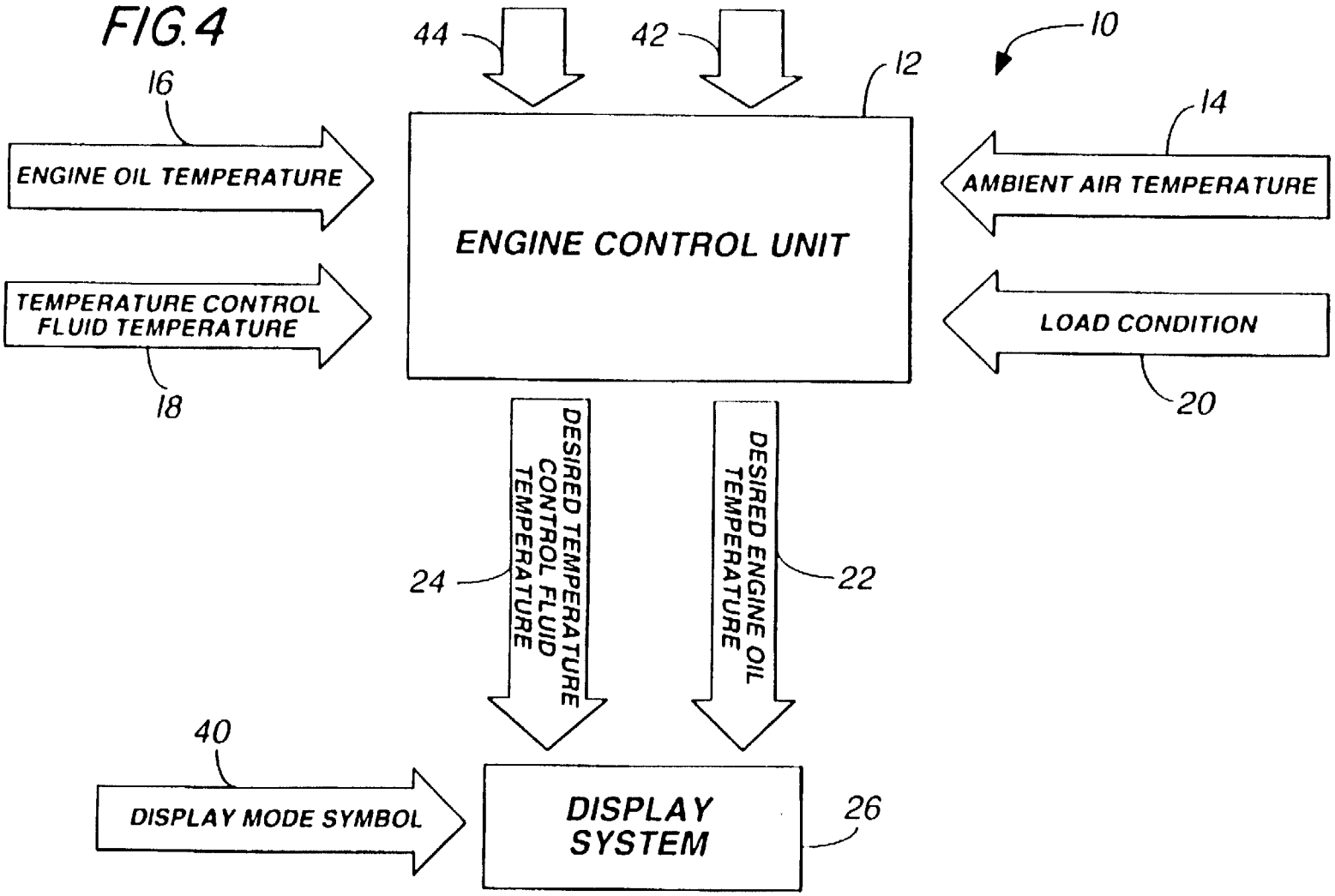
FIG. 4 is one embodiment of an engine control unit and display according to the present invention.

Referring to FIG. 4, an engine temperature display system 10 is diagrammatically shown. The engine temperature display system 10 includes an engine control unit (ECU) 12 which receives at least an ambient air temperature signal 14 and an engine oil temperature signal 16. In a preferred embodiment, the ECU 12 also receives a temperature control fluid temperature signal 18. These signals represent sensed temperature values as detected by one or more sensors in the temperature control system. The ECU 12 is a signal processor which receives and transmits signals. The ECU may include one or more forms of memory (e.g., EPROM, ROM, RAM, etc. ) for storing relevant data. Computations and/or comparisons are preferably performed within the ECU 12 on or with the signals that are received. The ECU 12 may be part of the engine computer which controls the overall operation of the vehicle. Alternately the ECU may be a separate signal processing computer which receives signals from the various sensors for controlling operation of the temperature control system. Engine computers and signal processors are well known to those skilled in the art and, thus, no further discussion is needed.

As discussed above, the ECU 12 compares the ambient air temperature signal 14 to an optimum engine oil temperature curve or to a series of temperature values for determining a desired engine oil temperature. The ECU 12 also compares the ambient air temperature to a temperature control curve for determining a desired temperature control fluid temperature. In a preferred system, the temperature control curve or the desired temperature control fluid temperature is adjusted to account for a current engine load condition. The ECU 12 may determine an adjustment factor by calculating the amount that the actual or sensed engine oil temperature exceeds the desired engine oil temperature. Alternately, a load condition signal 20 may be received by the ECU 12 which is indicative of the engine load condition. For example, the load condition signal 20 may represent the rate of change of the accelerator or the intake manifold vacuum pressure. The ECU 12 adjusts the desired temperature control fluid temperature or the temperature control curve in accordance with the engine load condition. The ECU 12 outputs the desired engine oil temperature signal 22 and/or the desired temperature control fluid temperature component 24.

The engine temperature display system also includes a display 26. The display 26 receives the desired engine oil temperature signal 22 and/or the desired temperature control fluid temperature component 24. The display 26 also receives the sensed engine oil temperature 16 and/or the sensed temperature control fluid temperature 18. These sensed signals may be received directly from the sensors or, more preferably, from the ECU 12. The display 26 then presents the received signals to the operator. The display 26 may also include a graphics generating/processing means, such as a microprocessor, for producing a visual cue in response to received signals. Graphics generating devices are well known in the art.

Figure 5:
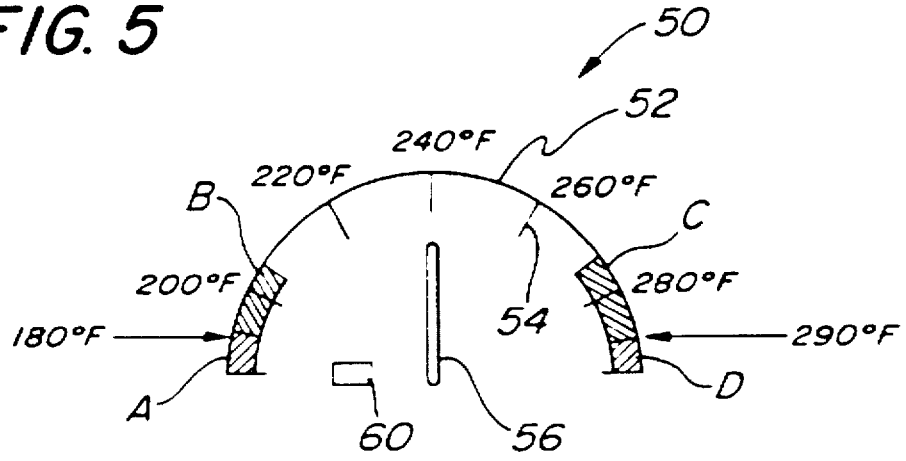
FIG. 5 illustrates an analog display embodiment according to the present invention.

FIG. 5 illustrates one embodiment of the display according to the present invention. The display, generally designated by the numeral 50, includes an analog gauge 52 for displaying the temperature of the engine oil. Although not shown, the analog gauge 52 is incorporated into an instrument panel of a vehicle such as a car or truck. The analog gauge 52 includes at least one and, more preferably, a plurality of temperature marks 54 representing various engine oil temperature values. The gauge 52 has a plurality of temperature zones (A, B, C and D) formed on it which represent temperatures ranges above the maximum optimum engine oil temperature and below the minimum optimum engine oil temperature. Each temperature zone is indicative of a different level of engine operating efficiency. For example, temperature zone A defines a first range of engine oil temperatures below 190° F. If the actual engine oil temperature falls within this range, the engine is not operating efficiently and sludge may begin to develop. Temperature zone B defines a range from about 190° F. to about 210° F. Although this temperature range is below the minimum optimum engine oil temperature, there may be situations when the engine oil will be operating near or within this range. Temperature zone C represents a range from about 270° F. to about 290° F. Similar to temperature zone B, there are situations when the vehicle may be operating in this range. For instance, in hot weather conditions with the vehicle operating under high loads. Temperature zone D represents a temperature range above about 290° F. This is a very critical range. If the engine oil temperature falls within this range, the engine is operating very inefficiently and the engine oil viscosity may begin to break down. The ranges for the temperature zones will, of course, vary depending on the engine configuration. In order to distinguish between the temperature zones, color coding and/or shading may be utilized. A temperature indicator such as a temperature indicating needle 56 is rotatably mounted with respect to the analog gauge 52.

The display 50 may also include one or more indicator lights 60. The indicator light 60 is preferably designed to convey to the operator when the engine has reached its minimal operating state before engaging the transmission. In one embodiment, the indicator light is a function of the engine oil temperature and engine oil pressure. Referring back to FIG. 4, the ECU receives a signal 42 indicative of the sensed engine oil pressure. The ECU then determines whether the sensed engine oil pressure signal 42 is above a minimum threshold value. The ECU also determines whether the sensed engine oil temperature 16 is above a minimum threshold value. If both sensed signals are above their respective minimum threshold values, the ECU sends a indicator signal to the display. It is preferable that, when the engine is initially started, the indicator light 60 is immediately turned on. Only after the ECU determines that both sensed signals are above their respective minimum threshold values is the indicator light turned off. Alternately, the indicator light 60 can be controlled as a function of sensed engine oil temperature 16, engine oil pressure 42 and ambient air temperature 14. All three sensed values would be compared against threshold minimum values for determining whether the indicator light 60 should be on or off.

Figure 6A:
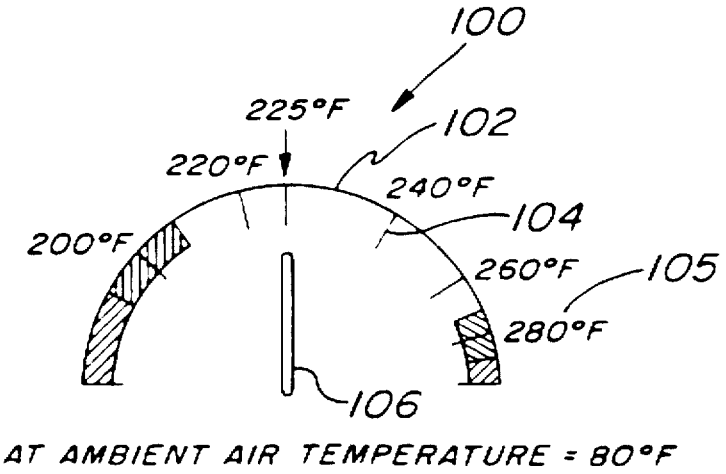
FIGS. 6A and 6B illustrate a second analog display embodiment during various ambient temperature conditions.
Figure 6B:
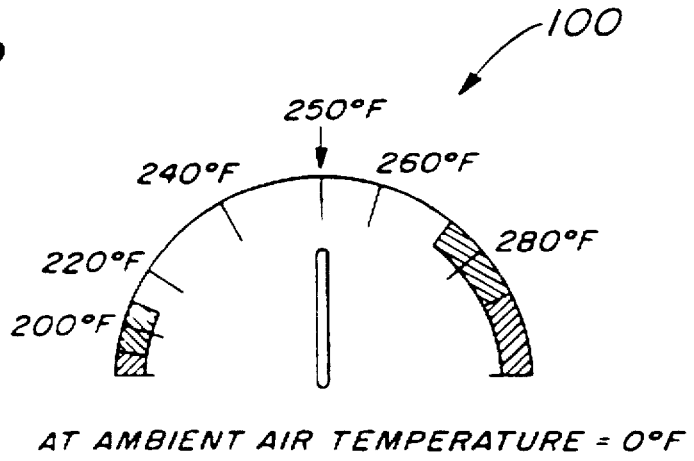

Referring to FIGS. 6A and 6B, an alternate analog display is illustrated (generally designated by numeral 100). In this embodiment, the display actively changes as a function of the desired engine oil temperature and the sensed engine oil temperature. Since the optimum engine oil is not a set value in the preferred embodiment, it is desirable to adjust the temperature zones, temperature marks and/or temperature values depending on the desired engine oil temperature. This type of gauge provides a more accurate and consistent indication of the engine's operating efficiency.

The analog display 100 includes a gauge 102 with a plurality of temperature marks 104 and temperature values 105 associated with the gauge 102. A temperature indicating needle 106 is rotatable with respect to the gauge 102 and indicates the sensed engine oil temperature. The temperature marks 104 in this embodiment are not fixed on the gauge 102. On the contrary, the location of the temperature marks 104 on the gauge 102 will vary depending on the desired engine oil temperature. For example, referring to FIG. 6A, when the ambient air temperature is 80° F., the optimum engine oil temperature curve in FIG. 1 indicates that the desired engine oil temperature for operating the engine is approximately 225° F. The gauge 102 in the present embodiment adjusts the temperature marks 104 so as to locate a temperature mark 104' indicative of 225° F. oil temperature at a preferred location on the gauge 102. For example, in the illustrated embodiment, top dead-center is the preferred location for the desired temperature mark 104'. The surrounding temperature marks are then located in either a linear or non-linear pattern around the desired temperature mark 104'. If a non-linear pattern is utilized, the rotation of the temperature indicating needle 106 must be varied in a similar manner. Those skilled in the art can readily understand how to control the rotation of the needle 106 so as to accurately depict the temperature of the engine oil on the gauge 102. If temperature zones are incorporated onto the gauge, these can also be adjusted so as to correlate appropriately with the location of the desired temperature mark 104'.

FIG. 6B, illustrates the gauge 102 when the ambient air temperature is 0° F. Based on the optimum engine oil temperature curve, the desired oil temperature is approximately 250° F. The gauge 102 is adjusted so as to locate the temperature mark 104' indicative of 250° F. oil temperature at top dead-center. The surrounding temperature marks 104 are then located with respect to the 250° F. temperature mark in either a linear or non-linear manner.

By consistently locating the desired engine oil temperature mark 104' at the same location, the operator quickly and accurately can determine whether the engine is running at or near the optimum oil temperature.

In order to actively change the temperature marks of the gauge 102, it is contemplated that the analog display 100 is incorporated into an image display, such as a cathode ray tube, a liquid crystal display (LCD), or a plasm discharge display. The gauge 102 is generated and controlled on the image display by a computer or signal processor. For example, the entire analog display system 100 may be generated either by the ECU 12 or by a separate processor located in the instrument panel. Alternately, the gauge 102 and/or the temperature indicating needle 106 may comprise a non-computer generated mechanical components. The temperature marks 104, temperature zones and/or temperature values are generated by the processor and displayed on the mechanical components. Hence, only a portion of the display is generated by a processor. Those skilled in the art would readily understand and appreciate that various methods for displaying the analog gauge can be practiced within the scope of the claims.

Since the temperature values in the above embodiment vary as a function of the ambient air temperature, it may be desirable to not display the temperature values 105. That is, the gauge would include only the temperature marks 104 and the temperature indicating needle 106. Otherwise, frequent changes in ambient air temperature would cause the temperature values 105 to continuously change, distracting the operator.

Similarly, the location and orientation of the temperature marks 104 and associated temperature indicating needle 106 may fluctuate as ambient air temperatures change. To prevent this, time and/or temperature delays may be designed into the processor so as to delay adjustment of the gauge until a predetermined threshold is reached. For example, if the ambient air temperature fluctuates between 0° F. and 5° F., the optimum engine oil temperature value fluctuates between about 250° F. and about 245° F. In a display system which is designed to locate the optimum oil temperature value at the preferred location on the gauge 104', the temperature indicating needle 106 will have to continuously be adjusted to point to the actual oil temperature, even though actual oil temperature may not be changing. To correct for this fluctuation, one preferred embodiment monitors the time between ambient air temperature fluctuations and delays adjusting the gauge until a preset amount of time has elapsed. That is, if the system detects frequent ambient air temperature shifts, it delays adjusting the gauge until the fluctuations have stopped or the time between fluctuations is greater than a preset threshold.

Figure 7:
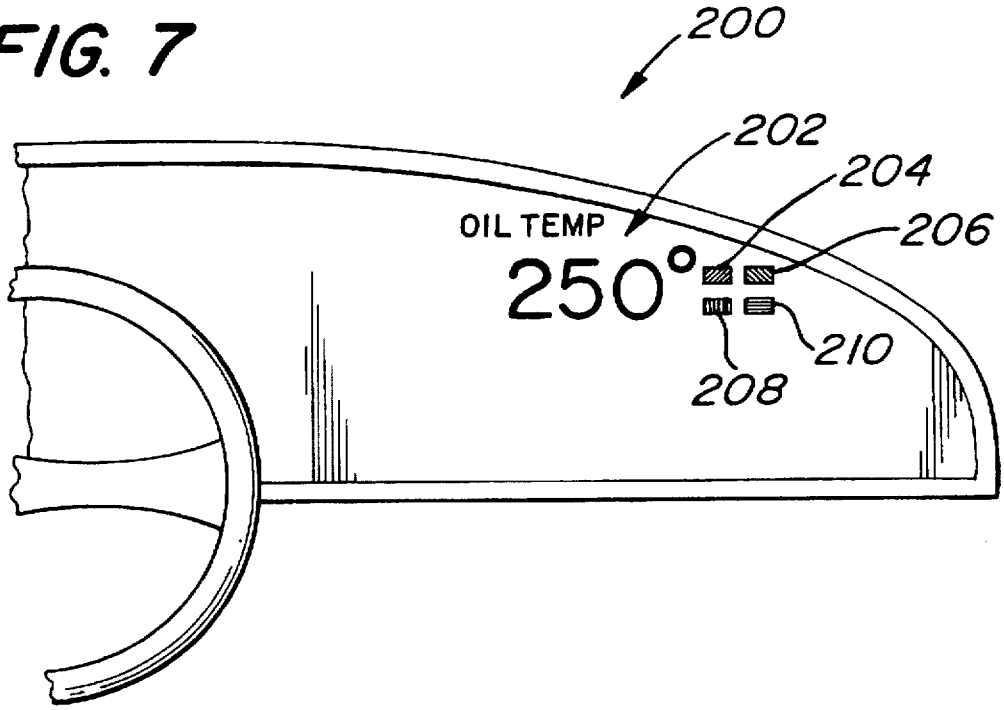
FIG. 7 is a digital display embodiment according to the present invention.

Referring to FIG. 7, another display embodiment is illustrated as configured in an instrument panel of a vehicle. In this embodiment, generally designated 200, the display is a digital display and includes a digital gauge 202 for presenting an engine oil temperature. Preferably, the digital gauge 202 displays the desired engine oil temperature value as determined by an optimum engine oil curve similar to the one shown in FIG. 1. The digital display 200 also includes a plurality of indicators 204, 206, 208 and 210. Each indicator represents a predetermined range of actual engine oil temperatures and may be color coded. For example, indicator 204 may be shaded light blue and represent a first range of engine oil temperatures below the desired engine oil temperature (e.g., 235° F. to 245° F.). This range may be representative of the engine operating slightly inefficient. The next indicator 206 may be dark blue and represent a second range of engine oil temperatures below the desired engine oil temperature (e.g., below 235° F.). This range may be representative of significantly inefficient operating engine. Indicator 208 may be shaded light orange and represent a first range of engine oil temperatures above the desired engine oil temperature (e.g., 265° F. to 275° F.). This range may be representative of the engine operating slightly inefficient. The next indicator 210 may be bright red and represent a second range of engine oil temperatures above the desired engine oil temperature (e.g., above 275° F.). This range may, again, be representative of a significantly inefficient operating engine.

Figure 8:
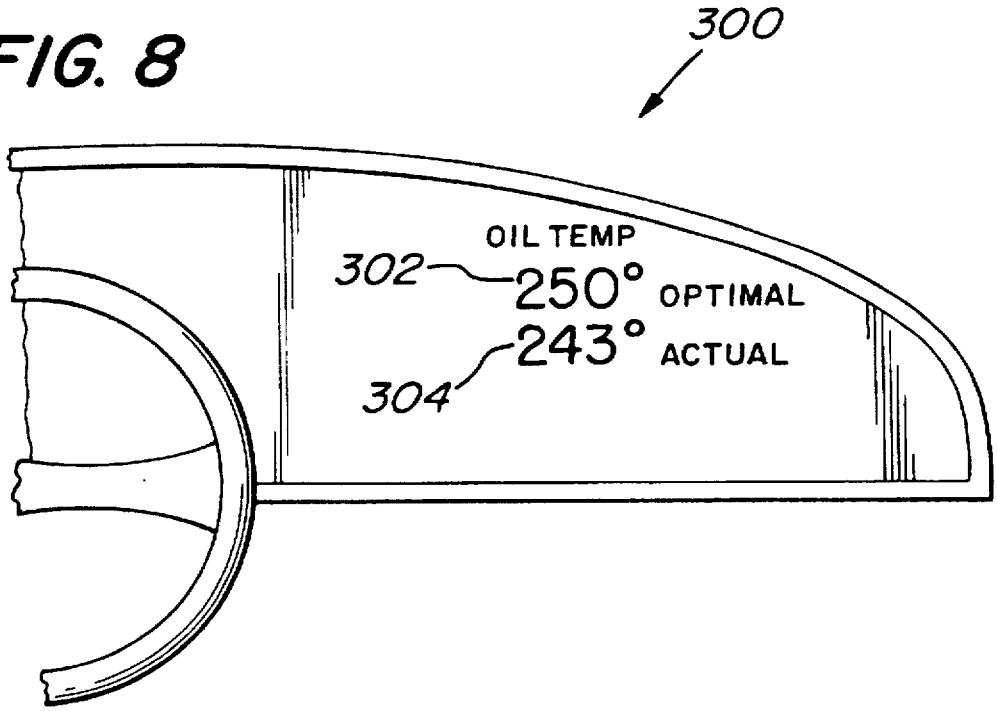
FIG. 8 is a second digital display embodiment according to the present invention.

FIG. 8 illustrates another digital display embodiment 300 which includes first and second digital gauges 302, 304 presenting engine oil temperatures. In this embodiment, the first digital gauge 302 displays the desired engine oil temperature as determined by a optimum oil temperature curve or series of oil temperature values. The second gauge 304 displays the sensed engine oil temperature. The gauges can be color coded or shaded to identify relevant information to the operator. For instance, the second gauge 304 can be displayed in a light blue color when the actual or sensed oil temperature is a predetermined amount below the desired engine oil temperature. A different color is utilized when the actual or sensed oil temperature exceeds the desired engine oil temperature by a predetermined amount.

Figure 9:
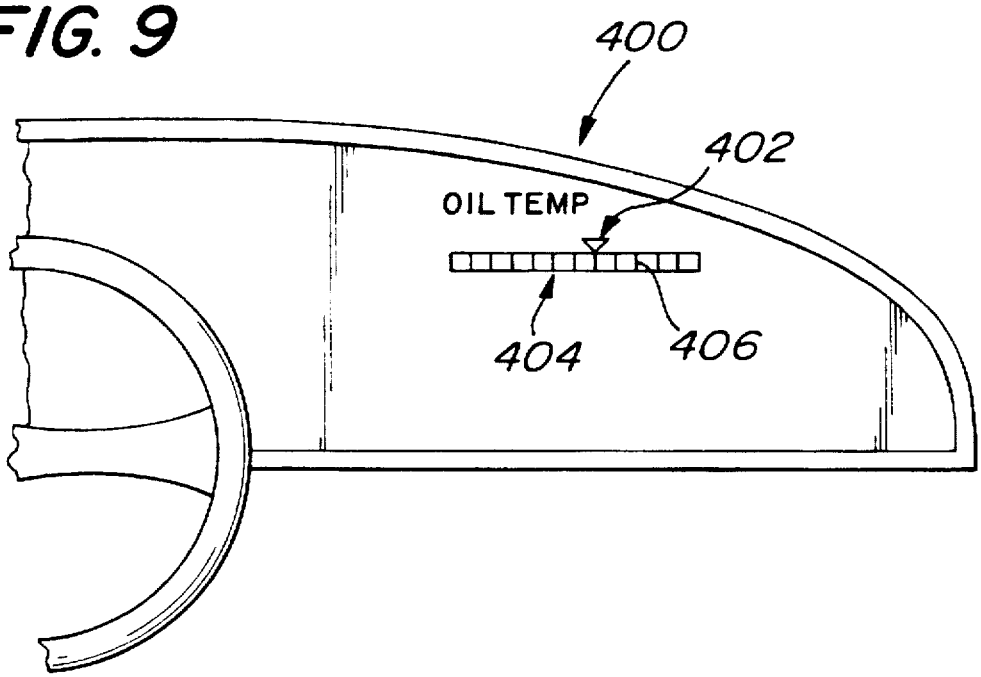
FIG. 9 is a third digital display embodiment according to the present invention.

Yet another embodiment of the display is shown in FIG. 9. The display is a computer generated linear tape display 400. The display 400 includes a desired engine oil temperature indicator 402 and an actual or sensed engine oil indicator 404. The tape display 400 may include a series of temperature marks 406 indicative of various oil temperatures. The tape display 400 may also be color coded or shaded to convey relevant information to the operator as discussed above with respect to the various other embodiments.

Figure 10:
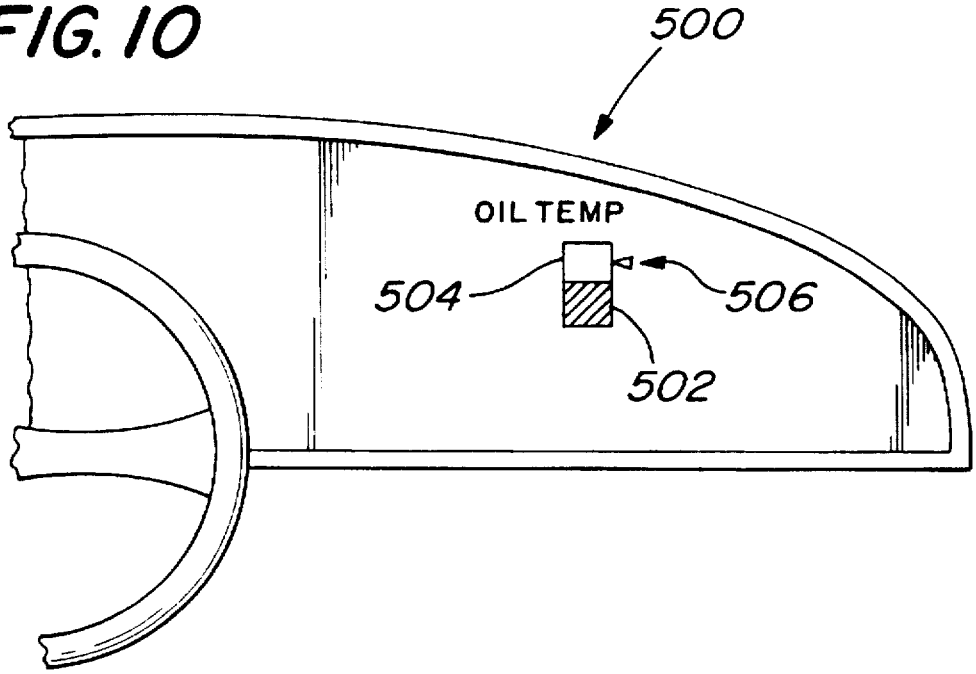
FIG. 10 is a bar graph display embodiment according to the present invention. 5

FIG. 10 illustrates an embodiment of the display as a bar graph 500. The bar graph display 500 graphically compares the sensed engine oil temperature as a shaded or colored block 502 which moves with respect to a reference block 504. The reference block 504 defines the engine oil temperature range. The desired or optimal engine oil temperature is depicted as a pointer or indicator 506 located adjacent to the reference block. The indicator moves with respect to the reference block 504.

Figure 11:
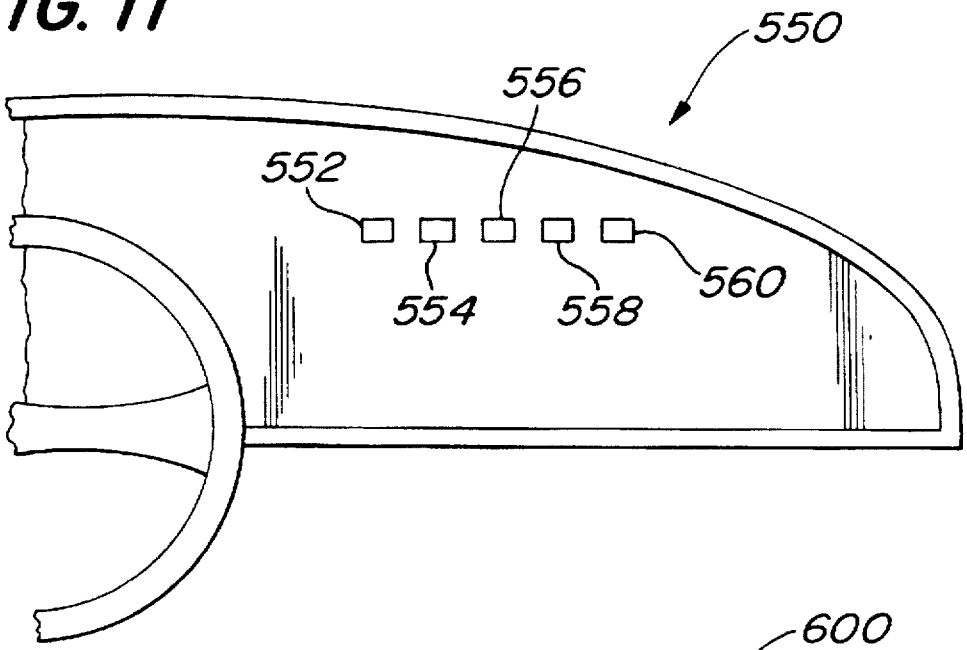
FIG. 11 is a light indicator display embodiment according to the present invention.

FIG. 11 illustrates a light indicator display embodiment 550. The light indicator display 550 includes a series of light indicators representing various temperature and/or pressure conditions. An oil pressure signal can be sent to the display either directly form an oil pressure sensor or from the engine computer. For example, in the illustrated embodiment, there are five light indicators (552, 554,556, 558, 560). The indicators are individually identified via shading and/or color coding. Indicator 552 may, for example, by designed to emit a dark blue color. Indicator 552 is preferably controlled so as to illuminate when the sensed engine oil and the sensed engine oil pressure are above respective first threshold values. When this light is illuminated, the engine is sufficiently warmed so as to minimize any likely damage during operation. Indicator 554 is preferably a light blue color and represents the temperature of the temperature control fluid. Indicator 554 is illuminated when the temperature of the temperature control fluid is within a predetermined range below a temperature control curve, such as the one shown in FIG. 2. Indicator 556 is preferably green in color and represents the temperature of the engine oil temperature. Indicator 556 is illuminated when the temperature of the engine oil falls within a prescribed range around the optimum engine oil temperature curve, such as the one shown in FIG. 1. The prescribed range may, for example, be ±15 degrees F. Alternately, the prescribed range may vary with ambient temperature (e.g., ±10 degrees F. when the ambient temperature is above 20 degrees F. and ±20 degrees F. when the ambient temperature is below 20 degrees F.) Indicator 558 is preferably orange in color and represents the temperature of the engine oil temperature alone or in combination with engine oil pressure. Indicator 558 is illuminated when the sensed temperature of the engine oil is within a range of engine oil temperatures, such as between about 270° F. and about 290° F. If oil pressure is also used to control indicator 558, then the sensed oil pressure is compared against a predetermined value to determine whether the indicator should be illuminated. Indicator 560 is preferably red in color and represents engine oil temperature alone or in combination with engine oil pressure. Indicator 560 is illuminated when the temperature of the engine oil is above a predetermined threshold value, such as 290° F. The indicator may also be illuminated when the oil pressure falls below a predetermined value.

The above examples are just some of the ways the desired engine oil temperature can be compared to the actual or sensed engine oil temperature. In all the embodiments, the desired engine oil temperature preferably varies with the sensed ambient air temperature. Accordingly, the optimum engine oil temperature is preferably periodically or continuously adjusted as discussed above. It should be appreciated that modifications to and variations of the above embodiments are well within the scope of this invention.

It is also contemplated that the engine oil lubrication system may include a viscosity detector. Referring back to FIG. 4, a viscosity detector senses the viscosity of the flowing engine oil and sends a signal 44 indicative thereof to the ECU 12 or, alternately directly to the display. A low viscosity value would indicate that the engine oil has degraded. Since the present invention is designed to extend the life of the engine oil by maintaining it at an optimum value, it is important that the operator is informed when the oil finally begins to degrade. Viscosity detectors and regulators are well known in the art. One such regulator is shown in U.S. Pat. No. 2,134,778. Hence, no further discussion of the viscosity detectors is needed to understand the present invention. If the ECU 12 determines that the sensed viscosity signal 44 is below a predetermined value, a signal (not shown) is sent to the display to illuminate an oil viscosity indicator light so that the operator is aware that the engine oil needs to be changed. The viscosity indicator light may be a separate light on the display which is in addition to any of the above disclosed display embodiments. Alternately, the signal may be used in combination with other signals for controlling a display component (e.g., if the oil viscosity is low, the indicator light 60 in FIG. 2 may remain on and/or blink even after the engine is sufficiently warm.)

It is also contemplated that the display 26 could provide the operator with the temperature of the temperature control fluid. The preferred display compares the sensed temperature control fluid temperature 18 to the desired temperature control fluid temperature value 18 as determined by a temperature control curve similar to the one shown in FIG. 2. The display embodiments described above for the engine oil temperature are readily applicable for displaying the temperature control fluid. The desired temperature control fluid temperature value 18 is displayed. The actual temperature control fluid temperature is then displayed in a comparative manner permitting an operator to access the status of the system.

In cold ambient temperatures, the temperature control system 10 allows the temperature control fluid temperature to rise to a level near its upper limit (e.g., approximately 280° F.). Displaying this high operating temperature to an operator may cause concern, even though the system is operating accurately. It is, therefore, desirable to adjust the temperature control fluid signals such that, when the temperature control system is operating in a normal range, the temperature indicating needle consistently points in a preferred direction, regardless of the temperature of the ambient air.

Figure 12A:
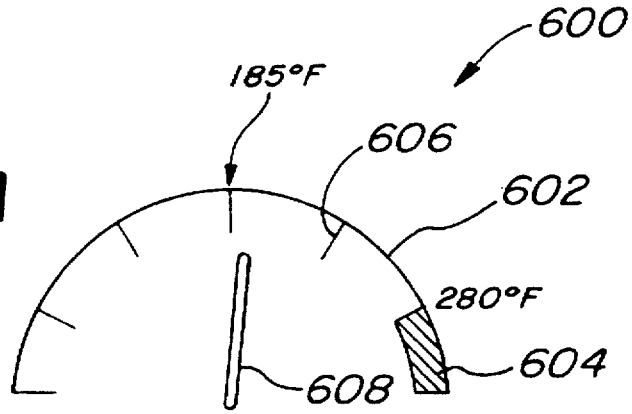
FIGS. 12A and 12B illustrate analog gauge displays for presenting the temperature of the temperature control fluid according to the present invention.
Figure 12B:
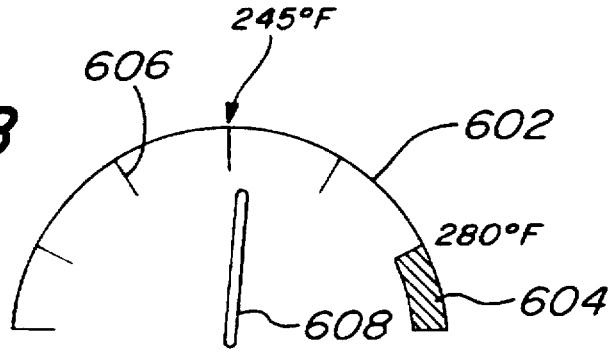

An example of this embodiment of the invention as an analog display 600 is shown in FIGS. 12A and 12B. FIG. 12A illustrates the analog display at an ambient air temperature of 80° F. According to the temperature control curve of FIG. 2, the desired temperature of the temperature control fluid is approximately 185° F. A temperature control system upper limit or "red zone" is depicted as above approximately 280° F. A gauge 602 depicts the red zone 604 on the right hand side of the gauge 602, as is customary in the art. A plurality of temperature marks 606 are placed around the gauge 602. The temperature mark 606' indicative of the desired temperature control fluid temperature value is located in a preferred position. The preferred position is generally determined by what the operator would consider to visually indicate "safe" and/or to correlate with other instrument panel or display gauges. In the illustrated embodiment, the preferred location is top-dead center. A temperature indicating needle 608 is rotates with respect to the gauge 602 and indicates the actual temperature control fluid temperature. For illustrative purposes, it is assumed that the actual temperature control fluid temperature is 190° F.

FIG. 12B shows the same gauge 602 when the sensed ambient air temperature is 0° F. The desired temperature control fluid temperature value is approximately 245 ° F. based on the temperature control curve shown in FIG. 2. If the gauge 602 were not adjusted, the temperature mark indicative of 245° F. would be located very close to the red zone 604. In the exemplary embodiment illustrated in FIG. 12B, the temperature marks 606 are adjusted such that the desired temperature control fluid temperature value is approximately at top-dead center (the preferred temperature mark position 606'). The temperature marks 606 and/or red zone 604 may be linearly or non-linearly spaced from the preferred temperature mark position 606'. The red zone 604 is shown substantially unchanged in this embodiment so as to further minimize the operators concern about the temperature of the temperature control fluid approaching the red zone 604. Since the scaling of the temperature marks is not linear in this embodiment, the temperature indicating needle 606 will have to be controlled, such as by the ECU, so as to accurately depict the current temperature control fluid temperature.

Alternate display embodiments for the temperature control fluid should be readily apparent to those skilled in the art based on the foregoing discussion. For example, it may be desirable to provide the operator with the capability to choose between a variety of display formats. As shown in FIG. 4, the operator selects a desired display causing a signal 40 to be sent to either the ECU 12 or the display 26. The appropriate display it then provided and the signals adjusted accordingly.

The above displays have been discussed as being embodied in the instrument panel of a vehicle. However, it is also contemplated that the above displays may be incorporated into a test apparatus for testing the temperature control system in a vehicle. The test apparatus displays one or more of the gauges disclosed above on a display screen for review by maintenance personnel.

Figure 13:
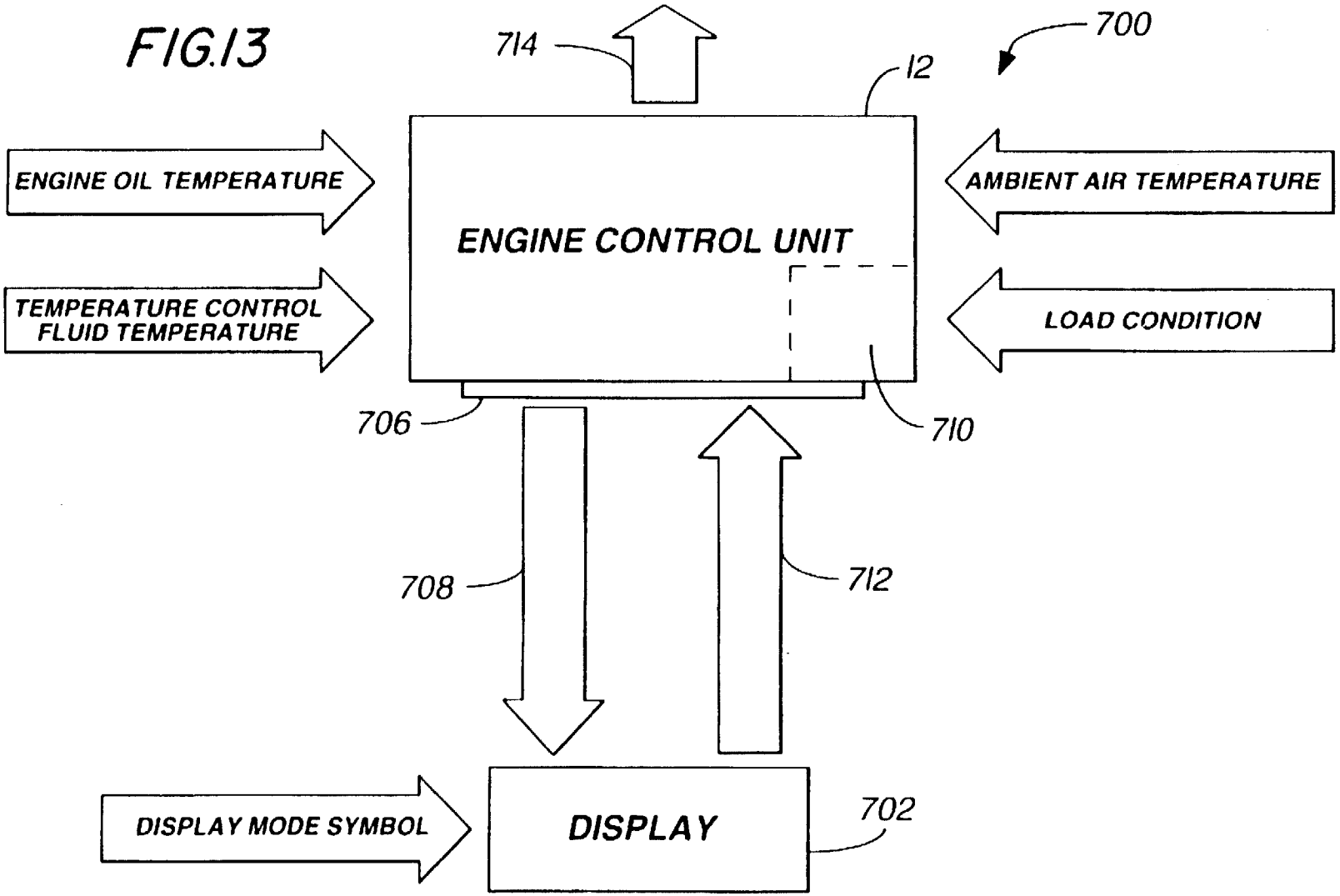
FIG. 13 is an alternate embodiment of the engine control unit and display according to the present invention.

Referring to FIG. 13, a testing system 700 is shown according to the present invention. The testing system 700 includes a test display 702 attached to an ECU 704 of the temperature control system through an input/output interface 706, such as a multi-pin connector or databus. The interface 706 permits signals 708 to be transmitted between the test display 702 and an ECU 704.

In one embodiment of the invention, the ECU 704 includes a memory 710 such as a random access memory. The memory stores past temperature control system data, such as sensed ambient air temperatures, sensed temperature control fluid temperatures, sensed engine oil temperatures, optimum engine oil temperature values, and desired temperature control fluid temperature values. The test display 702 receives signals 708 indicative of the stored data. The test display then presents the data in any of the gauge display formats discussed above. This permits a maintenance person to ascertain the operational history of the temperature control system.

In an alternate embodiment of the test system, the test display 702 transmits signals 712 to the ECU 704. The signals 712 may be indicative of sensed ambient air temperature, sensed engine oil temperature, and/or sensed temperature control fluid temperature. The signals 712 may be manually input into the test display 702 by the maintenance person or may be part of a test program stored in memory in the test display. The ECU receives the signals 712 and determines a desired engine oil temperature value and/or desired temperature control fluid temperature value for the signals 712. These determined values are then transmitted back to the test display 702 for presentation to the maintenance person and/or comparison with predetermined values. This embodiment of the test system permits a maintenance person to determine the accuracy of the program stored in the ECU 704.

The test display may also cause the ECU 704 to send signals to one or more flow control valves 714 to cause actuation into a desired position and/or to test the operational state of the valves. The test display then receives signals 712 from the ECU 704 which are indicative of the position of the valves and/or the operational state of the valves. From these series of signals, the testing display can readily ascertain the overall functional state of the temperature control system.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

We claim:

1. A system for displaying engine temperature information for a temperature control system in an internal combustion engine, the system comprising:

a first temperature sensor for sensing an ambient air temperature and providing a signal indicative thereof;

a second temperature sensor for sensing an engine oil temperature and providing a signal indicative thereof;

a third temperature sensor for sensing a temperature of the temperature control fluid and providing a signal indicative thereof;

an engine computer for receiving the sensed temperature signals of the ambient air, the engine oil and the temperature control fluid, the engine computer comparing the sensed ambient air temperature to a first set of predetermined values having an ambient air temperature component and an engine oil temperature component, the engine computer determining a desired engine oil temperature based on the comparison of the sensed ambient air temperature to the set of predetermined values, the engine computer providing a signal indicative of the desired engine oil temperature;

a display system for receiving and displaying the desired engine oil temperature signal and the sensed engine oil temperature signal.

2. A system for displaying engine temperature information according to claim 1 wherein the display system is in a dashboard instrument panel of an automobile.

3. A system for displaying engine temperature information according to claim 2 wherein the display system is an analog display and wherein the desired engine oil temperature signal and the sensed oil temperature signal are analog signals.

4. A system for displaying engine temperature information according to claim 2 wherein the display system is a digital display and wherein the desired engine oil temperature signal and the sensed oil temperature signal are digital signals.

5. A system for displaying engine temperature information according to claim 1, the display further comprising:

a temperature mark indicative of a temperature value, the temperature mark being a function of the desired engine oil temperature; and an indicator for indicating the sensed engine oil temperature, the indicator being movable with respect to the temperature mark.

6. A system for displaying engine temperature information according to claim 5 wherein the temperature mark is movable with respect to the display, and wherein the engine computer positions the mark in a predetermined location.

7. A system for displaying engine temperature information according to claim 6 wherein the predetermined location is always in approximately the same location.

8. A system for displaying engine temperature information according to claim 1, the display further comprising:

a plurality of temperature zones, each zone being indicative of a range of temperature values and being visually differentiable from the other zones; and an indicator for indicating the sensed engine oil temperature, the indicator being movable with respect to the temperature zones.

9. A system for displaying engine temperature information according to claim 1 wherein the desired engine oil temperature is displayed as an alphanumeric value on the display, and wherein the sensed engine oil temperature is displayed in a comparative manner.

10. A system for displaying engine temperature information according to claim 9 wherein the sensed engine oil temperature is displayed as an alphanumeric value.

11. A system for displaying engine temperature information according to claim 9, the display further comprising a plurality of indicator lights, each indicator light representing a range of temperature values and being visually distinguishable from the other indicator lights, the sensed engine oil temperature being displayed by illuminating at least one indicator when the sensed engine oil temperature falls within the range of temperature values associated with the indicator light.

12. A system for displaying engine temperature information according to claim 1, the display further comprising:

a series of temperature marks representing various temperature values, a desired engine oil indicator movable with respect to the temperature marks, the desired engine oil indicator displaying the desired engine oil temperature, and a sensed engine oil indicator movable with respect to the temperature marks for displaying the sensed engine oil temperature.

13. A system for displaying engine temperature information according to claim 1, the display further comprises a bar graph with a reference block indicative of the overall range of engine oil temperatures, a temperature indicator block movable with respect to the reference block for providing a visual indication of the sensed engine oil temperature, and a desired engine oil temperature indicator positioned adjacent to the reference block at a location indicative of the desired engine oil temperature.

14. A system for displaying engine temperature information according to claim 1 wherein the engine computer compares the sensed ambient air temperature to a second set of predetermined values, the second set of predetermined values having a temperature control fluid temperature component and an ambient air temperature component, the engine computer determining a desired temperature control fluid temperature based on the comparison; and wherein the display receives a signal indicative of the engine oil pressure, the display further comprising a plurality of indicator lights, each indicator light being visually distinguishable from the others, the indicator lights including a first indicator light representing engine oil temperature and engine oil pressure threshold values, the first indicator light being illuminated when the sensed engine oil temperature and sensed engine oil pressure are each above respective threshold values, said light representing an engine operational condition wherein the engine is sufficiently warmed, a second indicator light representing a range of temperature control fluid temperature values below the desired temperature control fluid temperature, the second indicator light being illuminated when the sensed temperature control fluid temperature lies within the range, a third indicator light representing a first range of engine oil temperature values above and below the desired engine oil temperature, the third indicator light being illuminated when the sensed engine oil temperature falls within the first range, a fourth indicator light representing a second range of engine oil temperature values, the fourth indicator light being illuminated when the sensed engine oil temperature is within the second range, and a fifth indicator light representing a third range of engine oil temperature values, the fifth indicator light being illuminated when the sensed engine oil temperature lies within the third range.

15. A system for displaying engine temperature information according to claim 14 wherein the first range of engine oil temperature values varies with ambient air temperature.

16. A system for displaying engine temperature information according to claim 15 wherein the first range extends about 10° F. above and about 10° F. below the desired engine oil temperature when the ambient air temperature is above 20° F., and wherein the first range extends about 20° F. above and about 20° F. below the desired engine oil temperature when the ambient air temperature is below 20° F.

17. A system for displaying engine temperature information according to claim 1 further comprising a viscosity detector located within the engine oil for sensing viscosity of the engine oil, the detector providing a signal indicative of the oil viscosity, and wherein the display receives the oil viscosity signal, the display including an oil viscosity indicator light which is illuminated when the oil viscosity signal falls below a threshold value.

18. A system for displaying engine temperature information according to claim 1 wherein the display system is part of an engine operation test system, the engine operation test system monitoring performance of the temperature control system.

19. A system for displaying engine temperature information according to claim 18 wherein the engine operation test system provides an ambient air temperature to the engine computer representing the sensed ambient air signal, the engine computer determines a desired engine oil temperature based on the signal and sends the desired engine oil temperature to the engine operation test system, the engine operation test system compares the desired engine oil temperature against a predetermined engine oil temperature signal and provides an output signal based on the comparison.

20. A system for displaying engine temperature information according to claim 18 wherein the engine operation test system receives signals from the engine computer indicative of past sensed engine oil temperature and desired engine oil temperatures.

21. A system for displaying temperature information for a temperature control system in an internal combustion engine, the system comprising:

a first temperature sensor for sensing an ambient air temperature and providing a signal indicative thereof;

a second temperature sensor for sensing an actual engine oil temperature and providing a signal indicative thereof;

a third temperature sensor for sensing a temperature of the temperature control fluid and providing a signal indicative thereof;

an engine computer for receiving the sensed temperature signals of the ambient air, the engine oil and the temperature control fluid, the engine computer comparing the sensed ambient air temperature to a set of predetermined values having an ambient air temperature component and a temperature control fluid temperature component, the engine computer determining a desired temperature control fluid temperature based on the comparison of the sensed ambient air temperature to the set of predetermined values, the engine computer providing a signal indicative of the desired temperature control fluid temperature;

a display system for receiving and displaying the desired temperature control fluid temperature signal and the sensed temperature control fluid temperature signal.

22. A system for displaying temperature information according to claim 21 wherein the display system is in a dashboard instrument panel of an automobile.

23. A system for displaying temperature information according to claim 22 wherein the display system is an analog display and wherein the desired temperature control fluid temperature signal and the sensed temperature control fluid temperature signal are analog signals.

24. A system for displaying temperature information according to claim 22, wherein the display system is a digital display and wherein the desired temperature control fluid temperature signal and the sensed temperature control fluid temperature signal are digital signals.

25. A system for displaying temperature information according to claim 21, the display further comprising:

a temperature mark indicative of a temperature value, the temperature mark being a function of the desired temperature control fluid temperature; and an indicator for indicating the sensed temperature control fluid temperature, the indicator being movable with respect to the temperature mark.

26. A system for displaying temperature information according to claim 25 wherein the temperature mark is movable with respect to the display, and wherein the engine computer positions the mark in a predetermined location.

27. A system for displaying temperature information according to claim 26 wherein the predetermined location is always in approximately the same location.

28. A system for displaying temperature information according to claim 21, the display further comprising:

a plurality of temperature zones, each zone being indicative of a range of temperature values and being visually differentiable from the other zones; and an indicator for indicating the sensed temperature control fluid temperature, the indicator being movable with respect to the temperature zones.

29. A system for displaying temperature information according to claim 21 wherein the desired temperature control fluid temperature is displayed as an alphanumeric value on the display, and wherein the sensed temperature control fluid temperature is displayed in a comparative manner.

30. A system for displaying temperature information according to claim 29 wherein the sensed temperature control fluid temperature is displayed as an alphanumeric value.

31. A system for displaying temperature information according to claim 29, the display further comprising a plurality of indicator lights, each indicator light representing a range of temperature values and being visually distinguishable from the other indicator lights, the sensed temperature control fluid temperature being displayed by illuminating at least one indicator light when the sensed temperature control fluid temperature falls within the range of temperature values associated with the indicator light.

32. A system for displaying temperature information according to claim 21, the display further comprising a series of temperature marks representing various temperature values, a desired temperature control fluid indicator movable with respect to the temperature marks for displaying the desired temperature control fluid temperature, and a sensed temperature control fluid indicator movable with respect to the temperature marks for displaying the sensed temperature control fluid temperature.

33. A system for displaying temperature information according to claim 21, the display further comprises a bar graph with a reference block indicative of the overall range of temperature control fluid temperatures, a temperature indicator block movable with respect to the reference block for providing a visual indication of the sensed temperature control fluid temperature, and a desired temperature control fluid temperature indicator positioned adjacent to the reference block at a location indicative of the desired temperature control fluid temperature.

34. A system for displaying temperature information according to claim 21 further comprising a viscosity detector located within the engine oil for sensing viscosity of the engine oil, the detector providing a signal indicative of the oil viscosity, and wherein the display receives the oil viscosity signal, the display including an oil viscosity indicator light which is illuminated when the oil viscosity signal falls below a threshold value.

35. A system for determining the operational state of a temperature control system in an internal combustion engine, the system comprising:

a first temperature sensor for sensing an ambient air temperature and providing a signal indicative thereof;

a second temperature sensor for sensing an engine oil temperature and providing a signal indicative thereof;

a third temperature sensor for sensing a temperature of the temperature control fluid and providing a signal indicative thereof;

a flow control valve actuatable between a first and second position for controlling the flow of temperature control fluid;

an engine computer for receiving the sensed temperature signals of the ambient air, the engine oil and the temperature control fluid, the engine computer comparing the sensed ambient air temperature to a first set of predetermined values having an ambient air temperature component and an engine oil temperature component, the engine computer determining a desired engine oil temperature based on the comparison of the sensed ambient air temperature to the set of predetermined values, the engine computer providing a signal indicative of the desired engine oil temperature, the engine computer determining the position of the flow control valve as a function of the ambient temperature;

an engine operation test system for receiving the desired temperature signals, the test system comprising a display for displaying the desired temperature signals, and a test system computer for sending a plurality of test signals to the engine computer, the engine computer using the test signals to determine the position of the flow control valve, the engine computer providing a signal to the engine operation test system indicative of the position of the flow control valve for displaying on the display.

* * * * *